US006305294B1

(12) United States Patent
Hashino

(10) Patent No.: US 6,305,294 B1
(45) Date of Patent: Oct. 23, 2001

(54) APPARATUS TRAVELING ON CLOSED TRACK ON WALL SURFACE

(75) Inventor: Satoshi Hashino, Tsukuba (JP)

(73) Assignee: Agency of Industrial Science and Technology, Tokyo (JP)

( * ) Notice: Subject to any disclaimer, the term of this patent is extended or adjusted under 35 U.S.C. 154(b) by 0 days.

(21) Appl. No.: 09/616,940

(22) Filed: Jul. 14, 2000

(30) Foreign Application Priority Data

Jul. 15, 1999 (JP) ..... 11-201645

(51) Int. Cl.[7] ..... B61B 3/00

(52) U.S. Cl. ..... 104/91; 104/106; 105/29.1; 105/127; 238/122; 74/422

(58) Field of Search ..... 104/307, 91, 106; 105/153, 148, 155, 29.1, 29.2, 127; 74/29, 31, 120, 422, 457, 462, 465; 238/122, 123, 10 R

(56) References Cited

U.S. PATENT DOCUMENTS

| | | | | |
|---|---|---|---|---|
| 2,509,161 | * | 5/1950 | Meyers | 74/422 |
| 3,922,970 | * | 12/1975 | Glastra | 104/91 |
| 4,015,537 | * | 4/1977 | Graef et al. | 104/91 |
| 5,946,973 | * | 9/1999 | Blaha | 74/422 |
| 6,023,989 | * | 2/2000 | Imase et al. | 74/422 |

FOREIGN PATENT DOCUMENTS 10-279228 10/1998 (JP) .

* cited by examiner

*Primary Examiner*—S. Joseph Morano
*Assistant Examiner*—Lars A. Olson
(74) *Attorney, Agent, or Firm*—Oblon, Spivak, McClelland, Maier & Neustadt, P.C.

(57) ABSTRACT

The present invention provides an apparatus for traveling on a closed track on the surface of a wall in which the moving platform can circuit along a rail forming a closed track while being maintained in the same orientation. To this end, a crawling-type moving apparatus is configured with a moving platform 4 moving along a guide rail 2 disposed on a wall surface W provided with supporting units 8A to 8D which can slide on the guide rail, a rotational member provided on the moving platform, to be driven to rotate by a driving mechanism, and a plurality of mating units for generating a driving force by mating with guide faces, which are curved in a cycloidal shape, of driving guides disposed on the wall surface, the mating units being disposed around the rotational member at the same distance from each other. The guide rail 2 includes rails 3A to 3D forming a plurality of closed tracks disposed separated from each other and to be different in phase so as not to contact and intersect each other, the moving platform 4 is provided with the supporting units, each to mate with one of the rails, the supporting units of the moving platform, which mate with the outer rails, circumvent the inner rails, and supporting arms of the supporting units are rotatably mounted on the moving platform.

4 Claims, 4 Drawing Sheets

APPARATUS TRAVELING ON CLOSED TRACK ON WALL SURFACE

TECHNICAL FIELD OF THE INVENTION

The present invention relates to an apparatus which circuits on a guide rail forming a closed track provided on the surface of a wall.

DESCRIPTION OF THE RELATED ARTS

Apparatuses traveling along the surface of a wall and which travel along a wall of a building have been proposed by the inventor of the present invention, for example, in Japanese Unexamined Patent Application Publication No. 10-279228 and Japanese Patent Application No. 11-95074.

Each of the proposed apparatuses for traveling along the surface of a wall basically includes a guide rail along the surface of a wall and a moving platform slidingly and movably coupled with the guide rail. The moving platform can be driven along the guide rail by a driving mechanism. The driving mechanism includes a plurality of mating units provided around a rotating member provided at an end of a rotating shaft of the moving platform. The moving platform is movable along the guide rail at a substantially constant speed by a driving force generated by the mating units mating with guide faces of driving guides disposed in parallel to each other along the wall, the guide faces having a cycloidal shape. An apparatus traveling along the surface of a wall of this type is hereinafter called a crawling-type moving apparatus.

Each of the proposed crawling-type moving apparatuses is designed so as to move upward and downward along steps or to move vertically between upper and lower floors of a building, that is, to move along a guide rail having end-points at the two ends thereof. Therefore, it is difficult to operate a plurality of moving platforms at one time along the-guide rail, and there is a limit in the capacity it can carry.

This problem can be overcome effectively when the moving platform circuits along a guide rail arranged as a closed track. Particularly when the moving platform is configured so as to move along such a closed track driven by a crawling-type moving apparatus, a plurality of the moving platforms can independently move on the closed track, thereby improving transportation capacity. Moreover, the moving platforms can be used much more conveniently compared to a case in which the moving platforms are connected by a rope or the like and the rope or the like is driven to circuit.

In order to move the moving platforms while maintaining them in the same orientation, at least two rails must be included in the guide rail so that the two rails support each moving platform at two points thereof separated from each other. In order to maintain the moving platforms more stably, at least three rails are required to support each moving platform at at least three points thereof separated from each other. When the moving platforms circuit on a plurality of the rails used as a guide rail which forms a closed track, the plurality of rails intersect each other at various parts of the rails and the crawling-type moving apparatus crosses the rails, whereby there is a risk that interference will occur at various locations when each moving platform is supported at a plurality of points thereof by a plurality of rails and is driven by the crawling-type moving apparatus, thereby mechanically complicating the apparatus.

SUMMARY OF THE INVENTION

The inventor has performed various examinations and research in order to overcome these problems and to enable the moving platforms to move along a closed track using the above-described crawling-type moving apparatus. As a result, it has been confirmed that smooth movement on the circuit along the closed track can be realized, in which supporting units of the moving platform are prevented from interfering with rails and with drive guides and the like of the crawling-type moving apparatus, particularly by considering a mounting structure of the supporting units on the moving platform when a guide rail is formed with two rails to be positioned at two sides of the moving platform and each of the supporting units which mate with these rails is provided at four sides of the moving platform, and generally by cutting away a part of the rails when the guide rail is formed with a plurality of rails and the moving platform is stabilized by the supporting units provided thereon to mate with the plurality of rails.

A technical object of the present invention, which is based on such knowledge, is to provide an apparatus for traveling on a closed track on the surface of a wall, in which the moving platforms of the above-described crawling-type moving apparatus can be driven to circuit along the closed track while being maintained in the same orientation.

A more specific technical object of the present invention is to provide an apparatus for traveling on a closed track on the surface of a wall, in which a plurality of moving platforms can independently move along the closed track and mass transport along a guide rail is possible.

In order to achieve the above-described ends, according to the present invention, a crawling-type moving apparatus comprises a moving platform movable along a guide rail disposed on the surface of a wall of a building, the moving platform including a supporting unit to slidingly and movably mate with the guide rail; a rotational member to be connected to and driven to rotate by a driving mechanism, the rotational member being disposed on the moving platform; and a plurality of mating units disposed around the rotational member at the same distance from each other, mating with guide faces of driving guides disposed on the surface of a wall, and for generating a driving force. The guide faces of the driving guides disposed on the surface of a wall are formed in a substantially cycloidal shape so that a substantially constant speed in a direction of the movement along the surface of a wall is imparted to a rotational center of the rotational member. The crawling-type moving apparatus is characterized in that the guide rail disposed along the surface of a wall of a building includes a plurality of rails which form a closed track, the supporting units for mating with the rails are disposed at a plurality of positions of the moving platform separated from each other, the plurality of rails differ in phase from each other so as to support the moving platform, of which supporting units mate with the rails, substantially in the same orientation while the moving platform is traveling, and are disposed separated from each other so as not to come in contact with and intersect each other, and the guide faces of the driving guides project from the rails toward the moving platform.

In the apparatus for traveling on a closed track on the surface of a wall, the driving guides disposed in parallel to each other may be disposed toward one side from a line of the movement of a rotational center of the rotational member within a range of motion of the mating units of the rotational member when the rotational member moves along the guide rail, and the length of each driving guide may be set so that at least one mating unit is maintained mated with the guide face of the driving guide and each mating unit does not interfere with any driving guide during travel of the mating unit after the mating unit separates from the guide face of the driving guide until the same driving unit mates with the following guide face of the driving guide. With this arrangement, simple and stable driving is efficiently made possible.

In the apparatus for traveling on a closed track on the surface of a wall, the guide rail may include not less than three rails, the moving platform may be provided with the supporting units, each supporting unit may mate with one of the rails, and a part of the rails brought in contact with a supporting arm of the supporting unit during the movement of the moving platform may be cut away. The guide rail may include two pairs of rails to be positioned at two sides of the moving platform, respectively, the moving platform may be provided with the supporting units, each supporting unit to mate with one of the rails, supporting arms of the supporting units which mate with the outer rails may circumvent the inner rails, and the supporting arms may be rotatably mounted on the moving platform so as to avoid interference of the supporting arms with the inner rails. With this arrangement, interference between the supporting units and the rails is effectively avoided.

In the apparatus for traveling on a closed track on the surface of a wall arranged as described above, the moving platform included in the crawling-type moving apparatus can be driven to circuit on a closed track while being maintained in the same orientation, a plurality of the moving platforms can independently move along the closed track, and mass transport along a guide rail is made possible.

DESCRIPTION OF THE PREFERRED EMBODIMENTS

Figure 1:
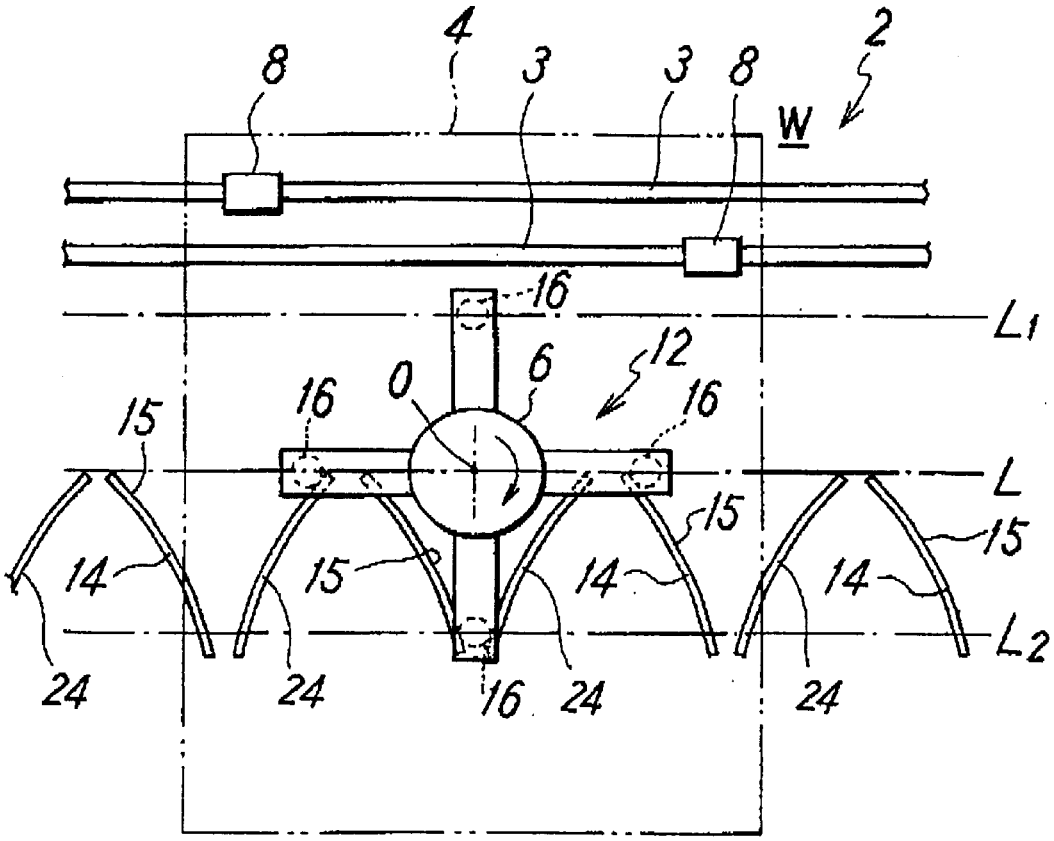
FIG. 1 is a schematic front view showing the configuration of a critical portion of a crawling-type moving apparatus according to the present invention.
Figure 2:
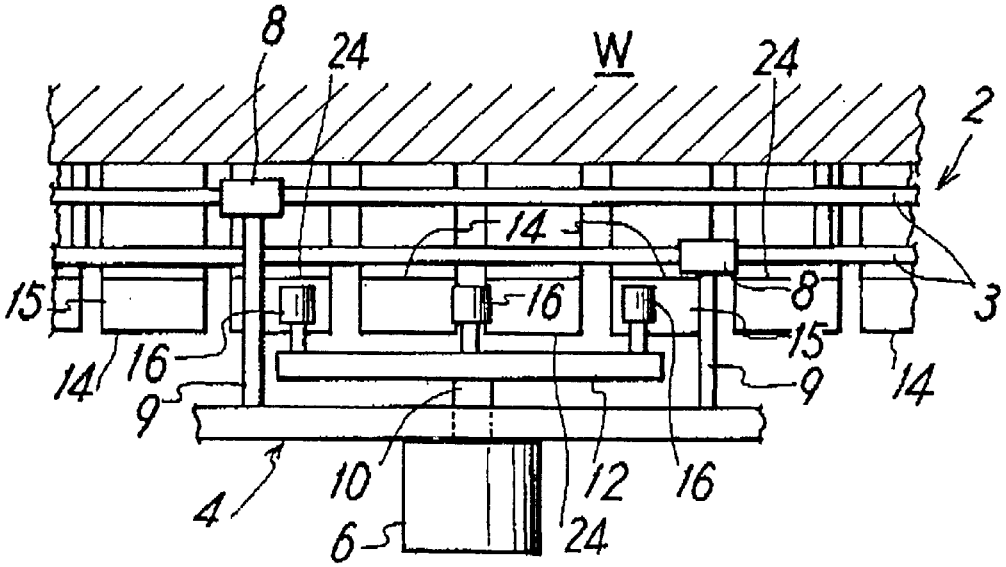
FIG. 2 is a planar sectional view of the same critical portion.

FIG. 1 and FIG. 2 show the configuration of a crawling-type moving apparatus used in the present invention.

The crawling-type moving apparatus, as shown in FIG. 1, includes a guide rail 2 including a plurality of rails 3 parallel to each other disposed on a wall surface W of a building, a moving platform 4 movable along the guide rail 2, and a driving mechanism 6 provided on the moving platform 4 for driving the moving platform 4. In the drawing, the two guide rails 3 serving as the guide rail 2 are shown, the rails 3 being disposed vertically and horizontally separated from each other. The guide rail 2 will be described below in more detail.

Figure 3:
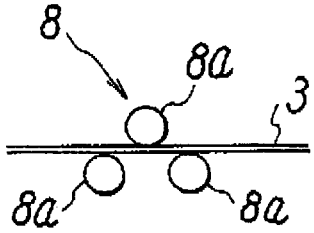
FIG. 3 is a front view of an example of the structure of a supporting unit.

The moving platform 4 is provided with supporting units 8 for maintaining the moving platform 4 in the same orientation by slidingly mating with the rails 3 which form the guide rail 2. The supporting units 8 are mounted on the moving platform 4 through supporting arms 9 when required. These supporting units 8 simply slidingly grip the rails 3 so that the moving platform 4 moves along the rails 3. The supporting units B are mounted to the moving platform 4 or to the supporting arms 9 rotatably because the supporting units 8 must rotate according to the curvature of the curved rails 3. The supporting units 8 may be configured with components, such as a pair of clamping parts which slidingly clamp a rail, a plurality of rollers 8*a* (see FIG. 3) which roll while nipping the rail 3, or the like.

The moving platform 4 is provided thereon with a rotational shaft 10 of which rotation is controlled by the driving mechanism 6 connected therewith. The rotational shaft 10 is provided with a rotational member 12 at an end thereof, the rotational member 12 including a plurality of arms to be driven to rotate in parallel to the wall surface W. A plurality of mating units 16 for generating a driving force by sequentially mating with guide faces 15 of a number of driving guides 14 disposed on the wall surface W are provided at the same distance from each other around the rotational member 12, that is, at the ends of the arms included in the rotational member 12.

The rotational member 12 may have a rotational disk-like shape or any wheel-like shape, the rotational plane thereof being parallel to the wall surface W provided with the driving guides 14. The mating units 16 disposed around the rotational member 12 are preferably configured with rollers or the like which are rotatable.

The driving guides 14 to be provided on the wall surface W in parallel to each other at the same distance from each other are disposed toward one side (downwardly in the drawing) from a line of movement L of a rotational center O of the rotational shaft 10 within a range of motion of the mating units 16 of the rotational member 12 (between lines L1 and L2 in FIG. 1) when the moving platform 4 moves, that is, when the rotational member 12 moves, along the guide rail 2. The guide faces 15 which are surfaces of the driving guides 14 are curved and inclined to have a substantially cycloidal shape so that the rotational member 12 is driven at the rotational center thereof at a substantially constant speed in a direction of the movement along the wall surface W when the rotational member 12 rotates at a constant speed and the mating units 16 mate with the guide faces 15.

The length of each driving guide 14 is set so that at least one mating unit 16 is maintained mated with the guide face 15 of the driving guide 14 and each mating unit 16 does not interfere with any driving guide 14 during travel of the mating unit 16 after it separates from the guide face 15 of the driving guide until the same mates with the following guide face 15 of the driving guide. The guide faces 15 of the driving guides 14, which are cycloidal, are disposed substantially in parallel to each other across the same distance therebetween. As described below, the driving guides 14 are disposed in a curved direction according to the direction of movement of the moving platform 4 in sections in which the moving platform 4 moves in a curved direction along the guide rail 2.

The guide faces 15 of the driving guides 14 project from the rails 3 toward the moving platform 4, thereby preventing the rotational member 12 and the mating units 16 provided thereon from interfering with the rails 3.

As shown in FIG. 1, in the crawling-type moving apparatus having the above-described configuration, when the rotational member 12 is rotated clockwise by the driving mechanism 6, one of the mating units 16 mates with the guide face 15 of the driving guide 14. This mating unit 16 moves the rotational member 12 in a direction of the movement (to the right) while the mating unit 16 moves along the guide face 15. Before the mating unit 16 separates from the guide face 15 and enters into the returning cycle, the following mating unit 16 mates with the guide face 15 of the adjacent (to the right) driving guide 14, and moves along this guide face 15. In this case, when each guide face 15 is curved in a cycloid, the rotational shaft 10 can move, as a result, in a direction of movement along the wall surface W at a substantially constant speed. During rotation of the rotational member 12, the mating units only move along the guide faces 15 of the associated driving guides 14, and do not interfere with other driving guides 14.

The moving platform 4 is not necessarily provided with one rotational member 12 which is driven by the driving mechanism 6. The moving platform 4 may be provided with a plurality of the rotational members 12, each mating with the guide face 15 of the same driving guide 14, in consideration of a case in which the driving guides 14 must be partly cut away so as to avoid interference between the driving guides 14 and the rails 3.

The driving guides 14 preferably have a shape along a cycloid which is a line of the movement of a moving point (the mating unit 16) on a circumference of a circle (the rotational member 12) which rotates and moves along the line of movement L so that the rotational member 12 moves at a constant speed; the driving guides 14 may have a similar shape to simplify manufacture and reduce cost.

In FIG. 1, the driving guides 14 are disposed in a position so as to drive the moving platform 4 in a direction from the left to the right. When the moving platform 4 is required to move in the opposite direction by inversely rotating the driving mechanism 6, driving guides 24 curved and inclined in a direction opposite to that of the driving guides 14 are disposed between each driving guide 14, symmetrical with respect to the driving guides 14. The driving guides 24 do not prevent the motion of the mating units 16 when the moving platform 4 moves to the right by mating the mating units 16 with the driving guides 14.

Figure 4:
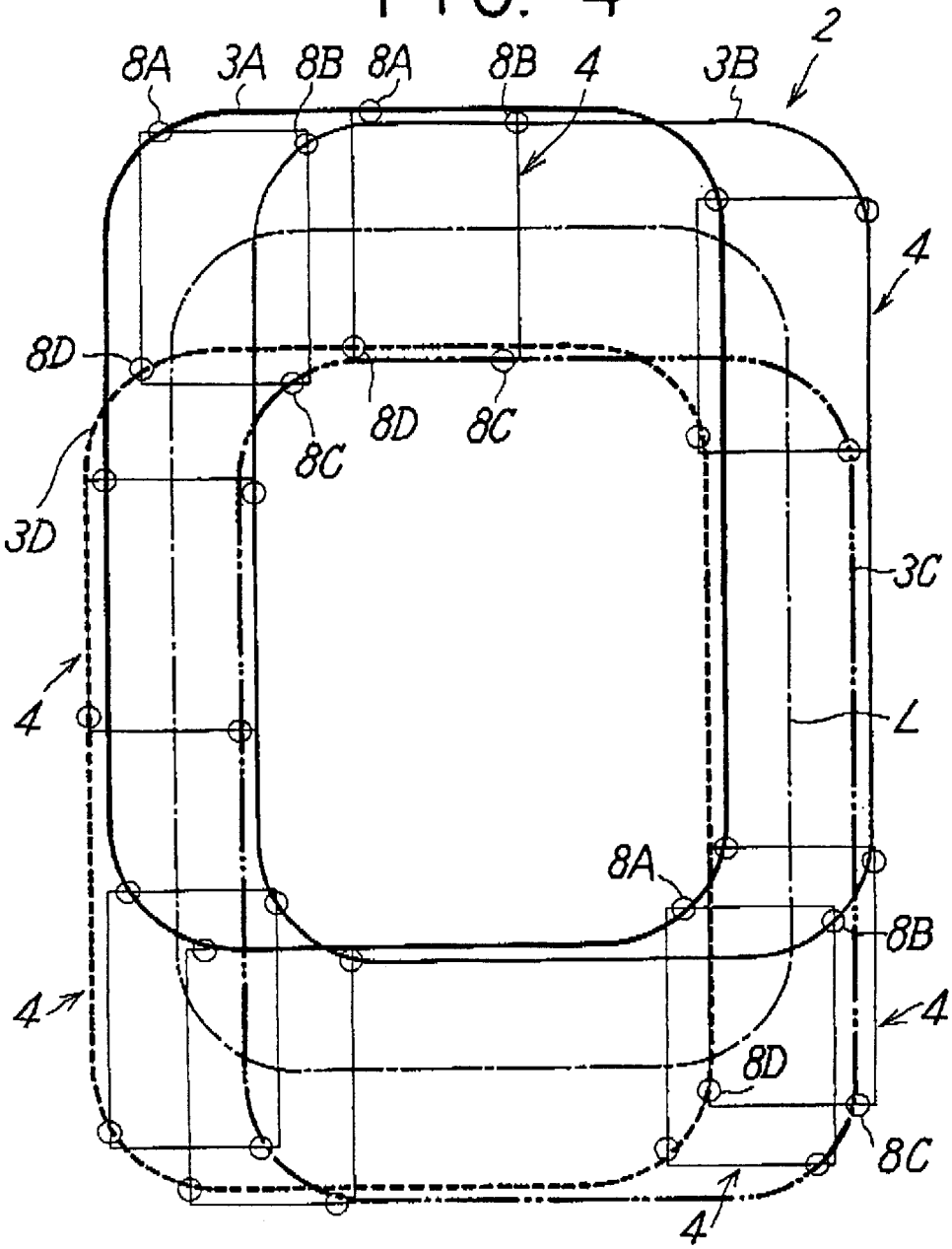
FIG. 4 is a schematic front view of a guide rail of an apparatus traveling on a closed track on the surface of a wall, according to the present invention, the guide rail to be disposed along the surface of a wall.
Figure 5:
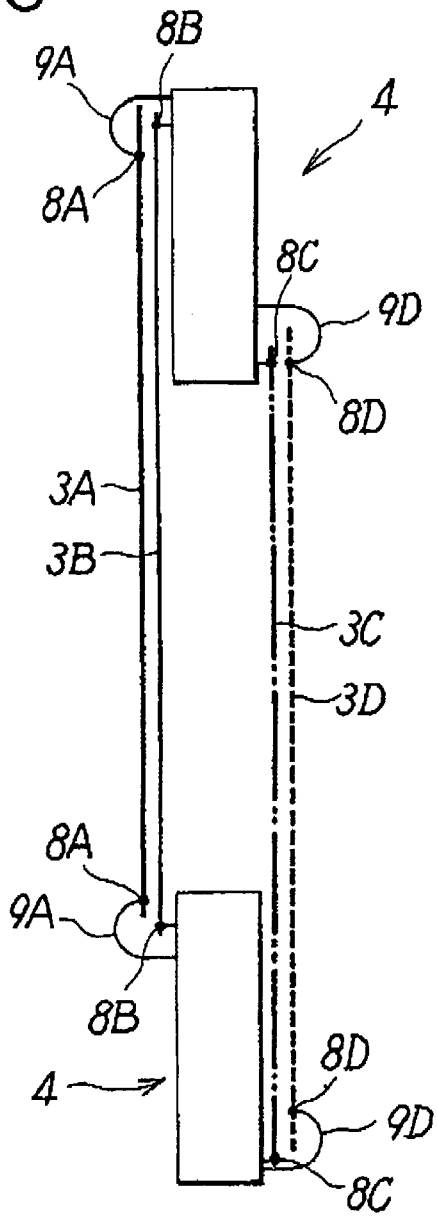
FIG. 5 is a schematic side view of an example of the manner in which a moving platform is supported by the guide rail shown in FIG. 4.
Figure 6:
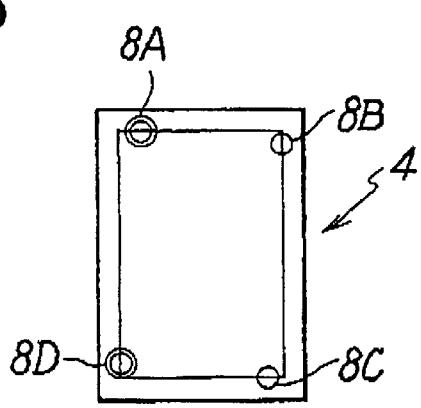
FIG. 6 is a descriptive drawing illustrating the supporting unit of the moving platform to be supported by the guide rail, shown in FIG. 5.

Referring to FIGS. 4 to 6, the guide rail 2 of an apparatus for traveling on a closed track on the surface of a wall to be mounted on the wall surface W of a building is described below.

The guide rail 2 includes at least two rails so as to maintain the moving platform 4 in the same orientation, in which the moving platform 4 is supported at two points thereof separated from each other. In order to support the moving platform 4 in a more stable manner, the moving platform 4 is preferably supported at three or more points thereof separated from each other by three or more rails.

The apparatus for traveling on a closed track on the surface of a wall includes the guide rail 2 forming a closed track and the moving platform 4 to circuit on the closed track. The guide rail 2 to be disposed on the wall surface W is configured with a plurality of rails forming the closed track. The moving platform 4 is provided with the supporting units 8 to mate with the rails at positions on the moving platform 4 separated from each other.

According to an embodiment, as shown in FIGS. 4 to 6, the guide rail 2 includes two pairs of rails 3A and 3B, and 3C and 3D associated with two sides of the moving platform 4, respectively. The moving platform 4 is provided with supporting =units 8A and 8B at the ends of the upper side, which is one of the two sides, of the moving platform 4 to mate with the rails 3A and 3B, respectively, and supporting units 8C and 8D at the ends of the lower side, which is the other of the two sides, of the moving platform 4 to mate with the rails 3C and 3D, respectively. The letter L in FIG. 4 denotes a line of the movement of a center of the moving platform 4.

The rails 3A and 3B, and 3C and 3D, having substantially the same overall shape, are disposed in different phases from each other so that the moving platform 4 can move while being maintained substantially in the same orientation, and are disposed at different levels from each other from the wall surface in a direction perpendicular thereto so as not to come into contact with each other at intersections so that the supporting units 8 can move smoothly.

Supporting arms 9A and 9D of the supporting units 8A and 8D, respectively, among the supporting units 8A to 8D to mate with the rails 3A to 3D, which mate with the outer rails 3A and 3D, respectively, must have a shape by which interference with the inner rails 3B and 3C can be avoided. Although a simplified schematic illustration in the drawing shows a case in which the supporting arms 9A and 9D circumvent the inner rails 3B and 3C, the supporting arms 9A and 9D must actually have a shape by which interference of the supporting arms 9A and 9D with the rails 3C and 3D can be avoided at any position thereof on the rails 3A and 3B.

In order to avoid interference with the inner rails 3B and 3C by changing the orientation of the circumventing parts, the supporting arms 9A and 9D of the supporting units 8A and 8D, respectively, which mate with the outer rails 3A and 3D, respectively, are rotatably mounted on the moving platform 4, and the rotational position is controlled according to the position of the moving platform 4. In FIG. 6, the supporting units 8A and 8D which rotatably support the moving platform 4 through the supporting arms 9A and 9D are represented by double circles. Because the supporting units 8A to 8D must rotate according to the curvature of the curved rails, the supporting units 8A to 8D must be rotatably mounted on the moving platform 4 either directly or through the supporting arms 9A to 9D, and the guide faces 15 of the driving guides 14 must be disposed projected from the rails 3A to 3D toward the moving platform 4.

In the apparatus for traveling on a closed track on the surface of a wall described with reference to FIGS. 4 to 6, the rails 3A to 3D having phases differing from each other are used for the guide rail 2 so as to maintain the moving platform 4 in the same orientation, and the plurality of rails intersect each other at various points thereof when viewed from the front. The moving platform 4 is provided with the supporting units 8A to 8D to mate with the rails 3A to 3D, respectively. The supporting arms 9A and 9D of the supporting units 8A and 8D, respectively, to mate with the outer rails 3A and 3D, respectively, circumvent the inner rails 3B and 3C, and the supporting arms 9A and 9D are rotatably mounted on the moving platform 4 so as to avoid interference with the inner rails 3B and 3C. With this arrangement, the moving platform 4 circuits along the guide rail while being maintained substantially in the same orientation, and the supporting units 8A and 8D and the supporting arms 9A and 9D do not interfere with the rails and the driving guides 14 of the crawling-type moving apparatus.

When any interference occurs at positions in which any rail crosses the driving guides 14 of the crawling-type moving apparatus, the interference can be resolved by cutting away a part of the driving guides 14 insofar as the driving effect is not reduced. The pair of rails associated with each of two sides of the moving platform, which form a guide rail, according to the embodiment shown in the drawing, may be fixed to a wall of a building positioned at one side of the moving platform by an appropriate supporting unit. One pair of the rails may be fixed to a wall positioned at one side of the moving platform and the other pair of the rails may be fixed to the other wall positioned at the other side of the moving platform. In this case, two crawling-type moving apparatuses are provided at both sides of the moving platform 4.

Figure 7:
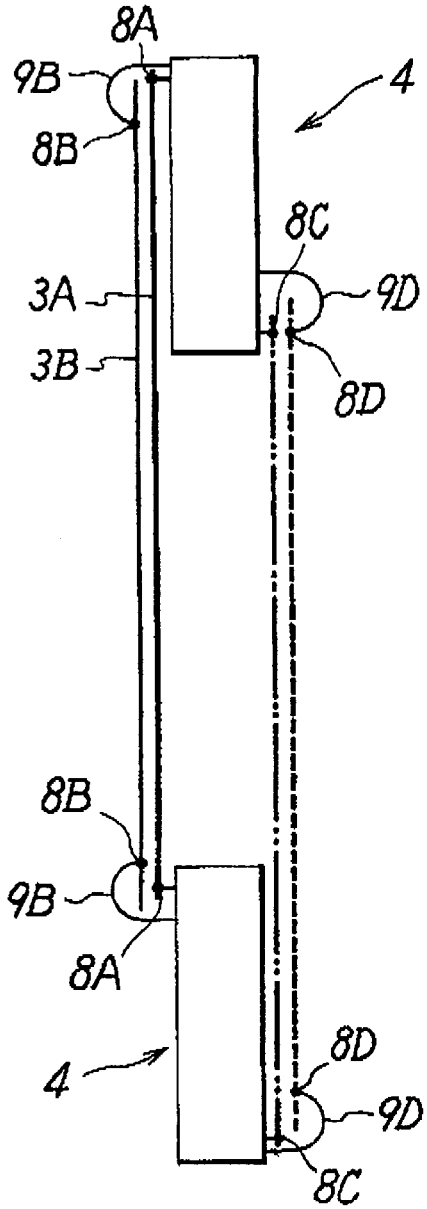
FIG. 7 is a schematic side view of another example of the manner in which the moving platform is supported by the guide rail shown in FIG. 4.
Figure 8:
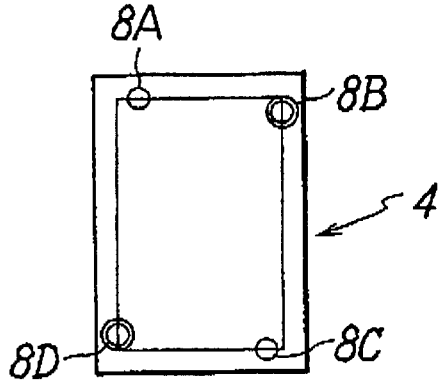
FIG. 8 is a descriptive drawing illustrating the supporting unit of the moving platform to be supported by the guide rail, shown in FIG. 7.

FIGS. 7 and 8 show another example of the arrangement in the guide rail 2 used in the apparatus for traveling on a closed track on the surface of a wall to be mounted on the wall surface W of a building. In this apparatus traveling on a closed track on the surface of a wall, the rail 3A and the rail 3B are disposed inversely, in contrast to the arrangement shown in FIG. 4. Therefore, the supporting structure and the like of the supporting units 8A and 8B are different in accordance with the difference in positions of these rails. However, since the other configurations and operations are the same as those in the embodiment described with reference to FIGS. 5 and 6, the same reference numerals are used and descriptions thereof are omitted.

The rails 3C and 3D may be also disposed inversely, in contrast with the arrangement shown in FIG. 4. The closed track formed by the guide rail 2 may be rectangular as shown in the drawing or may be of any other shape. The guide rail 2 may be curved instead of being planar insofar as it does not interfere with the operation of the crawling-type moving apparatus.

In the embodiments shown in FIG. 4 and FIG. 8, as typical examples, the guide rail 2 is formed with two pairs of the rails 3A and 3B, and 3C and 3D, to be associated with two sides of the moving platform 4, and the moving platform 4 is provided with the supporting units 8A to 8D disposed separated from each other on the moving platform 4, the supporting units 8A to 8D to mate with the rails. Generally, the guide rail 2 may be configured with at least two rails, and preferably with three or more rails so as to stabilize the orientation of the moving platform 4. When the number of rails is increased, there is a risk of interference and it is difficult to avoid the risk of interference of the rails with the supporting units and with a part of the driving guides and the like of the crawling-type moving apparatus. Even in this case, the interference can be avoided at least by the supporting arms of the supporting units, as in the embodiments shown in FIGS. 4 to 8. In order to avoid the interference, parts of the rails or the like coming in contact with the supporting arms of the supporting units may be cut away insofar as the moving platform 4 is not prevented from moving smoothly.

As described above, according to the present invention, an apparatus for traveling on a closed track on the surface of a wall can be provided in which a moving platform in the proposed crawling-type moving apparatus can circuit along the closed track while being maintained in the same orientation of the moving platform, a plurality of moving platforms can independently travel along the closed track, and mass transport along a guide rail is made possible.

What is claimed is:

1. An apparatus for traveling on a closed track on the surface of a wall comprising a moving platform movable along a guide rail disposed on the surface of a wall of a building, the moving platform including a supporting unit to slidingly and movably mate with the guide rail; a rotational member to be connected to and driven to rotate by a driving means, the rotational member being disposed on the moving platform; and a plurality of mating units disposed around the rotational member at the same distance from each other, mating with guide faces of driving guides disposed on the surface of a wall, and for generating a driving force, in which the guide faces of the driving guides disposed on the surface of a wall are formed in a substantially cycloidal shape so that a substantially constant speed in a direction of the movement along the surface of a wall is imparted to a rotational center of the rotational member, wherein the guide rail disposed along the surface of a wall of a building includes a plurality of rails which form a closed track, the supporting units for mating with the rails are disposed at a plurality of positions of the moving platform separated from each other, the plurality of rails differ in phase from each other so as to support the moving platform, of which supporting units mate with the rails, substantially in the same orientation while the moving platform is traveling, and are disposed separated from each other so as not to contact and intersect each other, and the guide faces of the driving guides project from the rails toward the moving platform.

2. An apparatus for traveling on a closed track on the surface of a wall according to claim 1, wherein the driving guides disposed in parallel to each other are disposed toward one side from a line of the movement of a rotational center of the rotational member within a range of motion of the mating units of the rotational member when the rotational member moves along the guide rail, and the length of each driving guide is set so that at least one mating unit is maintained mated with the guide face of the driving guide and each mating unit does not interfere with any driving guide during travel of the mating unit after the mating unit separates from the guide face of the driving guide until the same driving unit mates with the following guide face of the driving guide.

3. An apparatus for traveling on a closed track on the surface of a wall according to one of claims 1 and 2, wherein the guide rail includes not less than three rails, the moving platform is provided with the supporting units, each supporting unit mates with one of the rails, and a part of the rails brought in contact with a supporting arm of the supporting unit during the movement of the moving platform is cut away.

4. An apparatus for traveling on a closed track on the surface of a wall according to one of claims 1 and 2, wherein the guide rail includes two pairs of rails to be positioned at two sides of the moving platform, respectively, the moving platform is provided with the supporting units, each supporting unit to mate with one of the rails, supporting arms of the supporting units which mate with the outer rails circumvent the inner rails, and the supporting arms are rotatably mounted on the moving platform so as to avoid interference of the supporting arms with the inner rails.

* * * * *